United States Patent [19]

Williams

[11] Patent Number: 4,815,156

[45] Date of Patent: Mar. 28, 1989

[54] BEDSPREAD

[76] Inventor: Linda E. Williams, 23 Southland Ter., Brockton, Mass. 02401

[21] Appl. No.: 182,512

[22] Filed: Apr. 18, 1988

[51] Int. Cl.[4] ..... A47G 9/00

[52] U.S. Cl. ..... 5/485; 5/488; 5/496; 5/499

[58] Field of Search ..... 5/482, 485, 486, 488, 5/490, 494–500, 502

[56] References Cited

U.S. PATENT DOCUMENTS

| | | | |
|---|---|---|---|
| 1,867,425 | 7/1932 | Swilzcl | 5/485 |
| 2,037,216 | 4/1936 | Echlin | 5/494 |
| 2,623,221 | 12/1952 | Hickman | 5/485 |
| 3,121,885 | 2/1964 | Cherry | 5/494 X |
| 3,243,827 | 4/1966 | Kintner | 5/482 X |
| 3,654,646 | 4/1972 | McMahon, Jr. | 5/497 |

FOREIGN PATENT DOCUMENTS

| | | | |
|---|---|---|---|
| 369169 | 3/1932 | United Kingdom | 5/485 |

*Primary Examiner*—Gary L. Smith
*Assistant Examiner*—Michael F. Trettel
*Attorney, Agent, or Firm*—Robert T. Gammons

[57] ABSTRACT

A bedspread with a panel attached to one end thereof to overlay pillows at the head of the bed, wherein the bedspread and the panel are provided with aligning tabs at the head end spaced apart a distance corresponding to the width of the mattress to thus enable centering the bedspread and the panel with respect to the mattress and pillows so that equal lengths thereof hang down at opposite sides.

8 Claims, 1 Drawing Sheet

BEDSPREAD

BACKGROUND OF THE INVENTION

Bedspreads, to be effective, should hang down equally from the opposite longitudinal sides of the mattress and should be tucked under the pillows. Additionally, in order to be neat, the sides of the bedspread overhanging the pillows must be arranged in pleats in order to hang straight down. These criteria are particularly difficult for children to accomplish. It is the purpose of this invention to provide a bedspread so structured as to enable easily aligning it with the sides of the mattress and with the pillows.

SUMMARY OF THE INVENTION

As herein illustrated, the bedspread according to this invention comprises a first rectangular panel of flexible sheet material of a length and width to extend longitudinally from the head of the mattress to the foot and transversely from side-to-side with an overhang at the foot and at each side, and transversely-spaced tabs secured to the head of the panel at a spacing corresponding to the width of the mattress for aligning the head of the panel transversely of the mattress such that the sides of the panel overhang the sides of the mattress equal amounts. The bedspread according to this invention comprises, in addition, an overlay panel of sheet material disposed transversely of the bedspread at the head of the first panel such as to provide a cover panel for pillows disposed at the head of the bed and transversely-spaced tabs secured to the cover panel at a spacing corresponding to the width of the mattress for aligning the opposite sides of the cover panel with the opposite sides of the bedspread. Desirably, there are transversely-spaced, parallel lines of stitching extending longitudinally of the first panel at a spacing corresponding to the width of the mattress for centering the first panel on the mattress such that the sides of the first panel hang equally throughout the length of the mattress. The cover panel for the pillows comprises a rectangular sheet of a width corresponding to the width of the first panel, is attached along one edge to the first panel in spaced, parallel relation to the head end of the first panel and is of a length longitudinally of the first panel extending beyond the head end of the first panel such as to provide a cover for pillows disposed on the first panel at the head of the bed. Desirably, the cover panel has transversely-spaced, parallel lines of stitching extending lengthwise thereof at a spacing corresponding to the width of the mattress and the overhanging opposite ends of the cover panel are tucked and stitched to fall straight down from the spaced, parallel lines of stitching.

The invention will now be described in greater detail with reference to the accompanying drawings, wherein.

Figure 4:
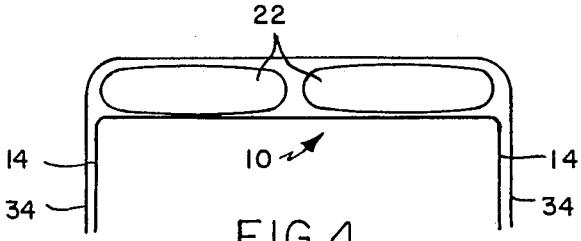
FIG. 4 is a transverse section taken on the line 4—4 of FIG. 2.
Figure 5:
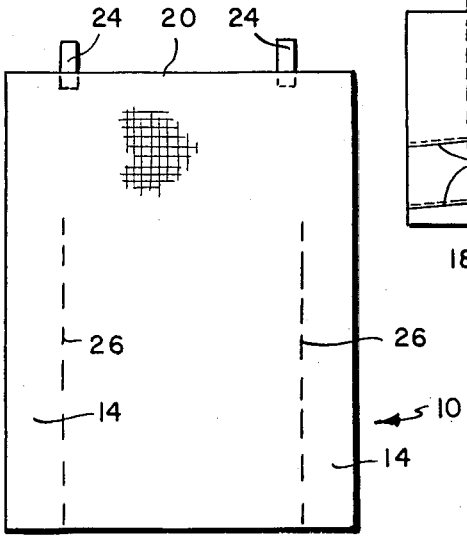
FIG. 5 is a plan view of the first panel of the bedspread.
Figure 6:
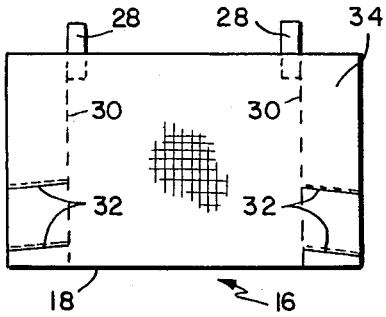
FIG. 6 is a plan view of the overlay panel.
Figure 7:
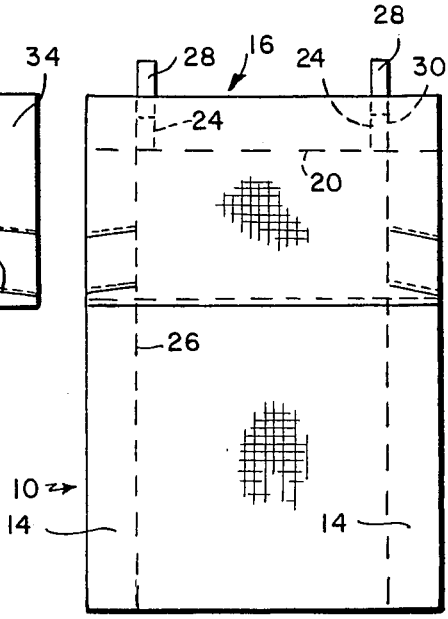
FIG. 7 is a plan view of the first panel with the overlay panel attached thereto.

It is particularly difficult for children to make their beds without one longitudinal side of the bedspread hanging down more than at the other side and with the spread tucked neatly under the leading edge of the pillow and hanging vertically from the opposite ends of the pillows at the opposite sides of the mattress. The bedspread shown in the above drawings is designed to enable children to quickly and easily make their beds in such fashion as to be neat and attractive. To achieve this, the bedspread according to this invention, as shown in FIGS. 5, 6 and 7, is comprised of a first panel 10 of rectangular configuration and of a length to extend from the head of the bed to the foot of the bed with an overhang in the form of a skirt 14 at the foot of the mattress, as shown in FIG. 3, and of a width to provide an overhang in the form of skirts 14-14 at each side of the mattress, as shown in FIG. 4. In addition to the panel 12, there is an overlying second panel 16, FIG. 6, of corresponding width but of lesser length which is attached to the first panel at the head end and transversely thereof along one transverse edge 18, FIG. 3, spaced from and parallel to the head end 20 of the first panel. The overlying second panel 16 is of a length longitudinally of the first panel such as to extend beyond the end 20 of the first panel, thus to provide a fullness transversely of the mattress, as shown in FIG. 3, to accommodate one or more pillows 22—22 disposed at the head of the mattress.

Figure 1:
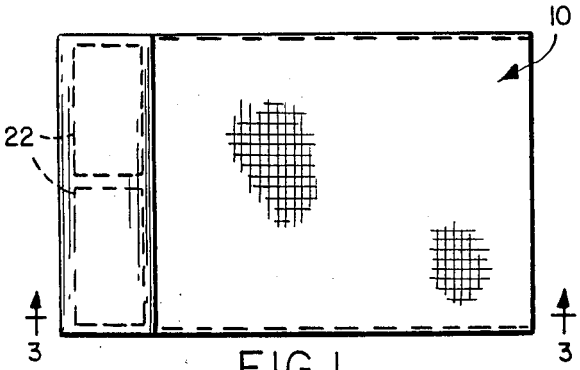
FIG. 1 is a plan view of the bedspread made according to this invention disposed on a mattress and embodying an overlay panel for disposition above pillows disposed at the head of the mattress.
Figure 2:
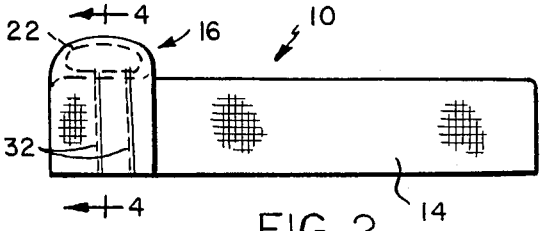
FIG. 2 is an elevation of FIG. 1.
Figure 3A:
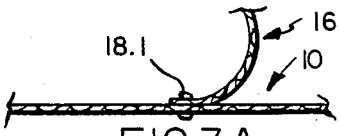
FIG. 3A is a fragmentary section showing the overlay panel detachably attached to the bedspread by means of snap fasteners.
Figure 3:
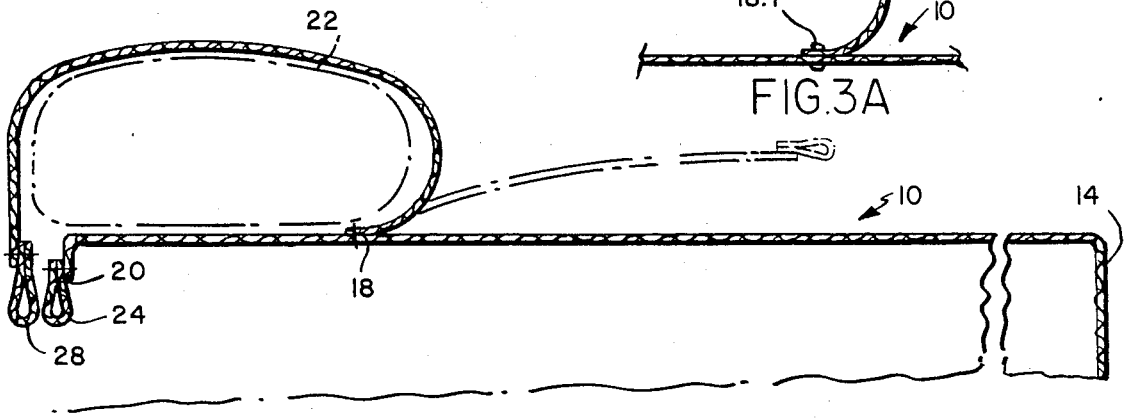
FIG. 3 is a longitudinal section to larger scale taken on the line 3—3 of FIG. 1.
Figure 3B:
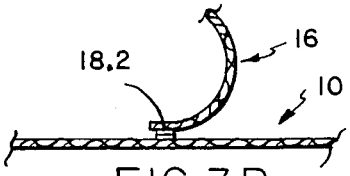
FIG. 3B is a fragmentary section showing the overlay panel detachably attached to the bedspread by means of zipper fasteners.

The overlying second panel 16 is shown, FIG. 3, as sewn to the panel 10, however, it may be detachably attached to the panel 10 by snap fasteners 18.1, FIG. 3A, or a zipper fastener 18.2, FIG. 3B.

In accordance with the invention, to align the first rectangular panel 10 lengthwise of the mattress so that skirts 14—14 at opposite sides of the mattress hang down equal distances, there are provided at the head end of the panel 10 transversely-spaced tabs in the form of loops 24—24, FIG. 3, stitched to the panel 10 at a spacing corresponding to the width of the mattress which may be grasped to dispose the head end of the panel in alignment with the opposite sides of the mattress and, hence, to provide equal overhang 14-14 at opposite sides of the mattress. Desirably, the panel 10 has spaced, parallel lines of stitching 26—26, FIG. 5, corresponding in spacing to the tabs 24—24 to assist in aligning the entire length of the bedspread in parallel relation to the sides of the mattress.

The overlying second panel 16, FIG. 6, which is stitched to the head of the panel 10 transversely thereof for covering the pillows is also provided with tabs 28—28 at a spacing corresponding to the tabs 24—24 to enable aligning the overlying second panel 16 with the head of the panel 10.

The overlying second panel 16 is provided with spaced, parallel, longitudinally-extending lines of stitching 30—30 to assist in centering the second panel 16 and to provide for continuity with the stitching 26—26 of the first panel 10.

Additionally, to cause the opposite ends 34—34 of the overlying second panel 16 to hang down perpendicularly with respect to the upper surface of the mattress, the opposite longitudinal sides are pleated as at 32—32 at an angle to the longitudinal stitching 30—30.

As thus constructed, it is possible for even a young child to dispose the bedspread on the mattress with the opposite sides hanging down at uniform distances, and with the head of the bedspread tucked under the pillows transversely of the mattress in parallel relation to the ends of the mattress and with the ends of the overlying second panel 16 hanging straight down.

While the panel 10 is illustrated in the figures as of a length and width to provide an overhang at the foot and at the opposite sides, the panel 10 may be of a width and length corresponding to the mattress and the overhang at the foot and sides may be provided by a skirt sewn to the panel at the foot and along the sides.

The bedspread as thus constructed, in addition to making it simple for a child or even an adult to properly align the spread with the sides of the mattress and tuck it under the pillow, further provides for constructing a bedspread with first panels and second panels of contrasting colors or patterns, which recommend it particularly for children.

What is claimed is:

1. A bedspread comprising a first rectangular panel of flexible sheet material of a length and width extending longitudinally from the head of a mattress to the foot thereof with an overhang at the foot of the mattress and with an overhang at each side of the mattress and transversely-spaced pull tabs secured to one end of said first rectangular panel at a spacing corresponding to the width of the mattress for aligning said one end of the first rectangular panel transversely of the mattress such that the overhang of the sides of said first rectangular panel overhang the sides of the mattress equal amounts and an overlying second panel of flexible sheet material of rectangular configuration disposed transversely of said first rectangular panel at said one end of said first rectangular panel, said second panel being of a width corresponding to the width of the first rectangular panel such that its opposite ends overhang the sides of the mattress equal amounts and wherein said second panel is attached to the first panel such as to provide a cover panel for pillows disposed at said one end of the first rectangular panel and transversely-spaced pull tabs secured to said cover panel at a spacing corresponding to the width of the mattress for aligning the opposite sides of the overlying second panel with the opposite sides of said first panel.

2. A bedspread according to claim 1 wherein there are transversely-spaced, parallel lines of stitching extending lengthwise of the first panel at a spacing corresponding to the width of the mattress for centering the first panel on the mattress such that the sides of the first panel hang equally throughout the length of the mattress.

3. A bedspread according to claim 1 wherein said overlying second panel is sewn along one edge to said first panel in spaced, parallel relation to said one end of the first panel and is of a length lengthwise of the first panel extending beyond said one end of the first panel such as to provide a cover for pillows disposed on the first panel at said one end of the bed.

4. A bedspread according to claim 3 wherein the overlying second panel has transversely-spaced, parallel lines of stitching extending lengthwise thereof at a spacing corresponding to the width of the mattress and the overhanging opposite sides of the second panel are tucked and stitched to fall straight down from the said parallel lines of stitching.

5. A bedspread according to claim 1 wherein the first and second panels may be comprised of sheet material of contrasting colors and patterns.

6. A bedspread according to claim 1 wherein the second panel is stitched to the bedspread.

7. A bedspread according to claim 1 wherein the second panel is removably attached to the bedspread by snap fasteners.

8. A bedspread according to claim 1 wherein the second panel is removably attached to the bedspread by zipper fasteners.

* * * * *